US008113302B2

(12) United States Patent
Orban

(10) Patent No.: US 8,113,302 B2
(45) Date of Patent: Feb. 14, 2012

(54) DRILLING TOOL

(75) Inventor: Jacques Orban, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/019,427

(22) Filed: Feb. 2, 2011

(65) Prior Publication Data

US 2011/0120778 A1 May 26, 2011

Related U.S. Application Data

(62) Division of application No. 10/560,391, filed on Apr. 11, 2006, now Pat. No. 7,891,442.

(30) Foreign Application Priority Data

Jun. 23, 2003 (GB) ..... 0314533.1

(51) Int. Cl.
*E21B 17/00* (2006.01)

(52) U.S. Cl. ..... 175/320; 166/242.2; 464/19; 464/20; 464/69

(58) Field of Classification Search ..... 166/242.1, 166/242.2; 175/320, 325.1, 325.5; 138/120; 464/18, 19, 20, 69, 99, 160, 51, 81, 85, 86, 464/97, 149
See application file for complete search history.

(56) References Cited

U.S. PATENT DOCUMENTS

| | | | | |
|---|---|---|---|---|
| 3,952,547 | A * | 4/1976 | Klein et al. | 464/51 |
| 4,226,288 | A | 10/1980 | Collins | |
| 4,463,814 | A | 8/1984 | Horstmeyer et al. | |
| 5,041,060 | A | 8/1991 | Hendershot | |
| 5,135,060 | A | 8/1992 | Ide | |
| 5,503,236 | A | 4/1996 | Tibbitts | |
| 5,687,806 | A | 11/1997 | Sallwasser et al. | |
| 5,887,655 | A | 3/1999 | Haugen et al. | |
| 6,041,860 | A | 3/2000 | Nazzal et al. | |
| 6,167,968 | B1 | 1/2001 | Allarie et al. | |
| 6,276,453 | B1 | 8/2001 | Bond | |
| 6,457,526 | B1 | 10/2002 | Dailey | |
| 2002/0134586 | A1 | 9/2002 | Baird | |

FOREIGN PATENT DOCUMENTS

| | | |
|---|---|---|
| EP | 0900914 | 3/1999 |
| EP | 1149980 | 10/2001 |

OTHER PUBLICATIONS

SPE57459 Coiled Tubing Ultrashort-Radius Horizontal Drilling in Gas Storage Reservoir:A Case Study; E.Kevin Stiles, Mark W.DeRoeun, I.Jason Terry, Steven P.Cornell, Sid J. DuPuy.

* cited by examiner

*Primary Examiner* — Kenneth L Thompson
*Assistant Examiner* — Sean Andrish
(74) *Attorney, Agent, or Firm* — Jianguang Du

(57) ABSTRACT

A drilling tool that has a flexible shaft so as to be able to make short radius curves while still being able to transmit torque and axial loads. The drilling tool includes a drill shaft for transmitting axial load, comprising a series of coaxial ring members connected together such that adjacent ring members are flexible in an axial plane relative to each other; each ring member being connected to an adjacent ring member by connecting member arranged to transmit torque therebetween; and axial supports extend between adjacent ring members so as to transmit axial loads therebetween.

8 Claims, 4 Drawing Sheets

DRILLING TOOL

CROSS-REFERENCE TO RELATED APPLICATIONS

This application is a divisional of U.S. patent application Ser. No. 10/560,391 filed Apr. 11, 2006, now U.S. Pat. No. 7,891,442.

FIELD OF THE INVENTION

The present invention relates to a drilling tool that can be used for drilling of short-radius deviated wells. In particular, the invention relates to a drilling tool with a flexible drill shaft.

DESCRIPTION OF THE RELATED ART

In the drilling of oil wells or the like, deviation of the direction of drilling is normally achieved by using a bent housing in the bottom hole assembly (BHA) together with a downhole motor to rotate the drill bit while weight is applied from the surface without rotating the drill string. Alternatively, a rotary steerable system such as the Power Drive system of Schlumberger can be used. Moveable stabilizers are operated from the BHA according to the rotational position of the BHA in the well so as to urge the drill bit in the desired direction. The flexibility in normal steel drill pipe is such that deviations with radius of 150 m can be achieved using these techniques.

Coiled tubing can also be used for drilling applications. In such uses a directional drilling BHA is connected to the end of the coiled tubing. One particular tool is the VIPER Coiled Tubing Drilling System (described in Hill D, Nerne E, Ehlig-Economides C, and Mollinedo M "Reentry Drilling Gives New Life to Aging Fields," Oilfield Review (Autumn 1996) 4-14) which comprises a drilling head module with connectors for a wireline cable, a logging tool including an number of sensors and associated electronics, an orienting tool including a motor and power electronics, and an drilling unit with a steerable motor. While the system is provided with power and data via a cable, it is also necessary to provide a coiled tubing to push the tool along the well.

One particular use of such drilling tools, is that of re-entry drilling in which further drilling operations are conducted in an existing well for the purposes of improving production, remediation, etc. A review of such techniques can be found in the Hill et al paper referenced above and in SPE 57459 Coiled Tubing Ultrashort-Radius Horizontal Drilling in a Gas Storage Reservoir: A Case Study; E. Kevin Stiles, Mark W. DeRoeun, I. Jason Terry, Steven P. Cornell, Sid J. DuPuy. By using a double articulated, it was possible in this case to achieve a build rate of 65° per 100 ft with short sections (5 ft) showing build rates of 100° per ft. Starting in a 5½ inch "vertical" casing, it was possible to reach horizontal in about 100 ft of vertical depth. It has been possible to achieve deviations of 15 m radius using such techniques.

All of the systems described above have physical limitations on the degree of curvature that can be obtained. When attempting to drill out of a cased hole, this means that it is necessary to mill an elongated hole in the casing for the BHA to be able to pass through into the formation around the borehole. Also, the amount of curvature that can be obtained is highly dependent on the type of rock in the formation.

Other techniques have been proposed for drilling laterally from an existing well.

U.S. Pat. No. 6,276,453 discloses a drilling tool including a drill shaft comprising a series of discs which can be guided along a curved path so as to extend laterally from a borehole and to transmit percussion forces to a drill bit at the end thereof. This technique is not applicable to rotary drilling and it is not possible to withdraw the shaft from the hole after drilling.

U.S. Pat. No. 5,687,806 and U.S. Pat. No. 6,167,968 describe a drilling system in which a flexible shaft is used to provide torque to a drill bit and a thrust support causes weight to be applied to the drill bit and to drive the bit a short way into the formation from the borehole. The diameter of the hole drilled and its extent into the formation are small and unsuitable for production of fluids or placement of measurement devices.

BRIEF SUMMARY OF THE INVENTION

It is an object of the present invention to provide a drilling tool that has a flexible shaft so as to be able to make short radius curves while still being able to transmit torque and axial loads.

The present invention provides a drilling tool including a drill shaft for transmitting axial load, comprising a series of coaxial ring members connected together such that adjacent ring members are flexible in an axial plane relative to each other; characterized in that each ring member is connected to an adjacent ring member by connecting member arranged to transmit torque therebetween; and axial supports extend between adjacent ring members so as to transmit axial loads therebetween.

The connecting members and axial supports preferably allow adjacent ring members to bend in one axial plane while remaining stiff in remaining stiff in another axial plane offset by up to 90° (preferably an orthogonal axial plane). In order to achieve this, the connecting arms and axial supports can be arranged such that the bending plane on one side of a ring member is different, preferably orthogonal, to that on the other side.

The connecting member and axial support can be constituted by the same physical structure, which typically comprises a pair of diametrically opposed axial links extending between circumferentially aligned points on adjacent ring members. The connection point of links extending axially from one side of a ring member are preferably offset from those extending in the axial opposite direction by up to 90°.

The physical structure can also comprise pairs of links extending between connection points on one ring member to connection points on an adjacent ring member circumferentially offset by up to 90°, such that each connection point is connected by a pair of inclined links to the adjacent ring. In one embodiment, the connection points of links extending from one side of a ring member are aligned with those extending in the axial opposite direction.

The connecting member and axial support can also be constituted by separate physical structures. In one such embodiment, the axial support comprises at least two axial links, preferably a pair of diametrically opposed axial links, extending between circumferentially aligned points on adjacent ring members, and the connecting member comprises inter-engaging teeth projecting from the adjacent ring members. The axial support can comprise at least two axial links extending between circumferentially aligned points on adjacent ring members, and the connecting member can comprise a torsion ring extending between the axial links and connected to a torsion link connected to one of the ring members at a point offset by up to 90° from the axial links. In such a case, the part of the axial link extending between the torsion ring and the ring member to which the torsion link is connected can be substantially more flexible that the part of the axial link extending from the torsion ring to the other ring member.

In another preferred embodiment, the axial support comprises at least two axial links extending between circumferentially aligned points on adjacent ring members, and the connecting member comprises pairs of links extending between connection points on one ring member to connection points on an adjacent ring member circumferentially offset by up to 90°, such that each connection point is connected by a pair of inclined links to the adjacent ring. Each axial link may be connected at one end to one of the ring members, and at the other end separated from the other ring member by a small distance such that when an axial compressive load is applied to the tool, the axial link is contacted by the other ring member.

It is particularly preferred that the tool comprises operable load supports which are moveable between a first position in which they are located between the ring members at points between the axial links and contacted by the ring members when compression is applied so as to resist bending in that direction, and a second position in which they are positioned away from the ring members so as not to be contacted when compression is applied and so not to resist bending in that direction. In one embodiment, the load supports comprise tension latches which, in the first position, are engaged by the ring members when tension is applied, and which, in the second position, are not engaged when tension is applied. The load supports can be normally biased into the first position and can be moved into the second position by application of pressure on a button attached to an outer surface of each load member.

A further embodiment of the drilling tool according to the invention has the axial support is connected at one end to one of the ring members, and at the other end is separated from the other ring member by a small distance such that when an axial compressive load is applied to the tool, the axial support is contacted by the other ring member, and moveable between a first position in which the axial support located between the ring members and contacted by the ring members when compression is applied so as to resist bending in that direction, and a second position in which the axial support is positioned away from the ring members so as not to be contacted when compression is applied and so as not to resist bending in that direction.

The various functional structures can be defined by providing cutouts in a tubular member.

Adjacent ring members can define a cell that is flexible in an axial plane, and the axial planes in adjacent cells being offset by a predetermined angle of up to 90°. A drilling tool according to the invention can comprise two concentric drill shafts that are rotatable relative to each other, such that when the axial planes of the cells are aligned, the tool can bend in that plane at that position, and when the axial planes of the cells are offset by the predetermined angle, bending of the tool at that point is resisted.

Preferably, a fluid conduit extends along the drill shaft to allow a drilling fluid to be supplied from one end of the shaft to the other.

A drilling assembly including a drill bit can be provided at one end of the shaft and a rotary motor connected to the other end of drill shaft for rotating the drill bit.

This invention provides a drilling shaft (or drill string) for rotary drilling which has a mechanical design allowing to operation either in a "rigid" bending mode or in a "soft" bending mode. The bending stiffness can be set to either rigid or soft bending mode over certain length of the shaft, and in both modes, the shaft allows transmission of the drilling torque when in rotary mode, and transmission of axial load (Weigh On Bit) in rotary or sliding mode: the shaft being resistant to buckling when in rigid mode. However, the shaft can easily comply to the shape of a guiding mechanism when is soft mode. This drilling shaft is a particular benefit while drilling a long straight hole perpendicular to a initially existing larger hole in which a drilling machine for providing a driving force to the shaft is located. As a particular example, this shaft may be useful for drilling lateral hole to a existing well for oil & gas production well.

Rotary drilling of a hole by a drill bit requires the following combination:

- The bit must be rotated at a certain RPM to insure the proper actions of the "cutters". The cutting action can be either shear or gouging or abrasion.
- The bit must be pushed in contact with the material to drill so that the cutters may interact properly with the material to drill. An axial force must be applied onto the bit. In the oil & Gas drilling industry, this is called Weigh-On-Bit (WOB).
- As a reaction to the WOB (via the friction of the bit), a torque is required to rotate the bit. This torque depends on WOB, RPM, material to drill, and properties of the bit, as well as the potential lubrication action due to some fluid (if present).

Rotation, torque and axial force are typically transmitted onto the bit from a remote point: in most drilling process, rotation and axial force are generated at the other end of the drill shaft by the drilling machine. For example, this is the case when using a hand drill to drill a block of any material. (steel, concrete, . . . ). The shaft needs to have the proper strength (and geometrical inertia) to transmit these drilling requirements. It must resist to the compression of the axial force to the torsion generated by the drilling torque. The torsion resistance is directly link to the geometrical inertia for torsion.

Furthermore, the shaft must resist to buckling. Buckling consists of large sideway deformation due to instability of the structure: these large deformations occur when the compression force is larger that a critical threshold:

$$\text{Critical Force}=Pi^2 E\, I_{bending}/L^2$$

With E=young modulus $I_{bending}$=Bending inertia

L=length of the unsupported shaft

This is the Euler formula for shaft with free-rotating end supports.

For Hollow Cylindrical Pipe:

$$I_{bending}=Pi(De^4-Di^4)/64$$

$$I_{torsion}=Pi(De^4-Di^4)/32$$

With De=External Diameter

Di=Internal Diameter

Above the critical buckling force, large sideway deformation of the drill shaft has several major issues:

- Friction between the shaft and bore-hole. The friction acts against the axial force and against the rotational torque generated at the powering end of the shaft. With this large loss in the hole, it is difficult to optimise the torque and axial load on the bit.
- Risk of self-blocking of the pipe in the well against axial displacement, by the anchoring effect of the pipe against the borehole: This is particularly true in large hole.
- Large pipe deformation. When combined with rotation, this may generate severe fatigue of the pipe.

Consequently, the design of the drill shaft is a compromise:

1) The section must be large enough to resist to the axial load $$\text{WOB}<Pi(De^2-Di^2)/4*\text{yield-stress}$$

2) The section inertia must be adequate for the torque (with the following typical formulae)

$$\text{Shear}_{max}=\text{Yield-stress}/2>0.5\ \text{Torque}*De/I_{torsion}$$

3) The shaft must not buckle $$\text{WOB}<Pi^2E\ I_{bending}/L^2$$

Based on relations 2 & 3, the shaft should have the $I_{bending}$ as large as possible. A method to reduce the risk of buckling is to introduce a system of guides for the shaft into the drilled well-bore: the presence of these guides reduces the length of buckling. This is typically performed in the drill string for oil & gas well drilling by the use of stabilizers within the section of the string in compression.

4) The drill shaft must be compatible with the removal (or lifting) of drilled cuttings in the annulus between the shaft and the borehole wall. For this reason, the shaft has to have a external diameter smaller than the hole diameter. This is the first limit to the pipe inertia. Furthermore, the pipe may have to be hollow to pump fluid (drilling mud) for, inter alia, cuttings removal and transport in the annulus. The presence of the bore in the pipe reduces slightly the pipe inertia.

5) The main motivation to reduce bending inertia is to insure compatibility with "directional drilling". In some industries, the drilled hole must follow complex trajectory. In other applications, the drill shaft is bent between the powering machine and the bit (a common application is the use of flexible shaft between hand-drilling tool and small bit). For these situations, the shaft must have a low bending inertia. This is directly in conflict with the criteria of torque transmission: the bending inertia and the torsion inertia are only different by a factor of 2 (for a cylindrical shaft). Furthermore, low bending inertia reduce the bucking performance.

As explained previously, a flexible shaft may be required in some drilling applications where the shaft is not operating as a straight structure, but in bent shape. Metal cables are often used for this purpose. It can be shown, that a tube under torsion load is submitted to shear stress in the cross section. By mathematical treatment, principal stresses can be shown to be tangential to the cylindrical surface at 45° from the main axis (one in compression, the other one in tension). Therefore, the cable typically has wires wrapped in multiple layers: the individual wires being typically at 45° from the main axis. This angle is +45° and −45°, alternately from layer to layer. Normally, the external layer is laid with the wires supporting tension load to avoid buckling of the wire under the tension generated by the drilling torque. If the external layer is laid with the wire in compression, it can deform towards the outside, making a bulge in the cable. The buckling of the individual strands typically occurs at low loads as each wire strand has a small diameter (which means an extremely small buckling survival capability).

Cables, when used as drilling shaft, have limited capability to transmit axial load to push the bit (WOB), as a cable has a low bending inertia. This apparent low inertia of the cable is due to the fact that a wire describes a spiral around the main axis. When the cable is flexed and due to the strand spiral, a wire strand is alternately in extension (when on the outside of the curve), and in compression when on the inside of the curve. If there were no friction between the wire strands of the cable, the wire strands would move slightly and would keep their initial length even though the cable is curved, while providing no reaction force (or momentum) against the imposed bending on the cable.

As a example in the ideal case (all wire strands are bend at the same rate; no friction between wire stands), a cable inertia would then be:

$$I_{bending_cable}=N\ I_{bensing\text{-}strand}$$

N=number of strands in the cable.

In the best case, (no void between strands)

$$\text{Section}_{cable}=N\ \text{section}_{strand}$$

Combining these 2 relations, we obtain:

$$I_{solid_tube}/N=I_{bending_cable}$$

This relationship shows that a solid tube has a higher bending stiffness than a cable. The cable stiffness reduces quickly when the number of strands increase (for a given cable diameter).

For some flexible drilling cables as used with hand drilling tool, axial load is transmitted by the flexible non-rotating guide hose around the flexible rotating cable. Axial load is transmitted from the guide hose onto the bit at the extremity of the flexible drilling assembly via a thrust bearing system.

In other applications (see, foe example, U.S. Pat. Nos. 5,687,806 and 6,167,968), the cable is guided by a fixed curved structure for most of the length of the cable. The cable is left unsupported in the radial direction only for short distance.

Directional drilling is common practice during drilling of oil & gas wells. For this purpose, the drill-string extends from the surface (drilling rig) down to the bit. In most conventional drilling, only a short section of the drill-string above the bit is in compression (due to its own weight) to generate axial force onto the bit. Most of the string is in tension to avoid buckling. The section in compression is kept short thanks to the use of heavy pipe called drill-collar. Furthermore, buckling is limited as this section can be guided in the hole by stabilizers that limit sideway displacement.

In case of horizontal wells, the pipe in the horizontal section of the well is in compression under the effect of the weight of heavy pipe is the inclined or vertical section of the well. In this situation, the drill-string in the horizontal section may be buckled.

In the curved section of the well (between sections of different direction or inclination), the pipe is bent. This bending generates stresses which may become fatigue when the pipe is in rotation. To limit fatigue (and the associated risk of rupture), bending stress should be limited: this requires low inertia pipe. Such a requirement may be in conflict with the need to delay buckling in the horizontal section. Furthermore sufficient inertia is required to transmit the drilling torque to the bit.

So, a drill string for oil &gas well drilling is a compromise of inertia to insure adequate performances. Drill-collar (higher inertia) often suffers from fatigue when rotated in the curved section of the well.

Lateral drilling is becoming common in the oil & gas industry, in which lateral holes are drilled from a main "vertical" hole. In most case, a lateral hole is drilled with techniques similar to directional drilling. Special processes and equipment may be needed to start the kick-off from the main hole: retrievable whipstocks are one possible approach. Conventional directional drilling equipment can only pass through a certain radius. Even in the most aggressive process, the radius of the curve cannot be smaller than 15 meters. This means that the intersection between the lateral hole and the main well becomes a long ellipse. This ellipse may decrease drastically the stability of the main hole.

In the oil & gas industry, wireline-conveyed drilling tools have been introduce to drill at right-angles from the main hole. This method can be used to drilling small channels or drains perpendicular to main hole which can replaces perforations which are conventionally made with shaped charges. Other tools can drill perpendicularly in the casing and the cement behind the casing to allow measurement of formation pressure. Some tools have also been proposed to drill fairly long perpendicular hole to insure larger production.

BRIEF DESCRITPION OF THE SEVERAL VIEWS OF THE DRAWINGS

The present inventions will now be described in relation to the accompanying drawings, in which:

FIG. 1 is a schematic view showing a general view of a drilling system incorporating the present invention;

FIGS. 2A and 2B are schematic views showing a first embodiment of a drill shaft according to the invention, having rings with links. FIG. 2A shows the first embodiment without torque; FIG. 2B shows a portion of the first embodiment under torque;

FIG. 3 is a schematic view showing a second embodiment of a drill shaft according to the invention, having rings with teeth;

FIGS. 4*a*1, 4*a*2 and 4*b* are schematic views showing a third embodiment of a drill shaft according to the invention, having rings with torsion rings. FIGS. 4*a*1 and 4*b* each shows an implementation of the embodiment in the unloaded position. FIG. 4*a*2 shows a portion of the implementation of FIG. 4*a*1 in a loaded position;

FIGS. 5A and 5B are schematic views showing a fourth embodiment of a drill shaft according to the invention, having rings with inclined links. FIG. 5A shows the fourth embodiment in a first position. FIG. 5B shows the fourth embodiment rotated 90 degrees;

FIGS. 6A and 6B are schematic views showing a fifth embodiment of a drill shaft according to the invention, having rings with axial and inclined links. FIG. 6A shows the fifth embodiment in a first position. FIG. 6B shows the fifth embodiment rotated 90 degrees;

FIGS. 7A and 7B are schematic views showing a modified version of the embodiment of FIG. 6, having rings with detached axial links. FIG. 7A shows the modified embodiment in a first position. FIG. 7B shows the modified embodiment rotated 90 degrees;

FIGS. 8A and 8B are schematic views showing a sixth embodiment of a drill shaft according to the invention, having rings with load supports and spring mounts. FIG. 8A shows the sixth embodiment in a first position. FIG. 8B shows the sixth embodiment rotated 90 degrees;

FIGS. 9A and 9B are schematic views showing a modified version of the embodiment of FIG. 8, having rings with load supports and buttons. FIG. 9A shows the modified embodiment in a first position. FIG. 9B shows the modified embodiment rotated 90 degrees;

FIGS. 10A and 10B are schematic views showing another modification of the embodiment of FIG. 8, having rings with load supports and tension latches. FIG. 10A shows the modified embodiment in a first position. FIG. 10B shows the modified embodiment rotated 90 degrees;

DETAILED DESCRIPTION OF THE INVENTION

Figure 1:
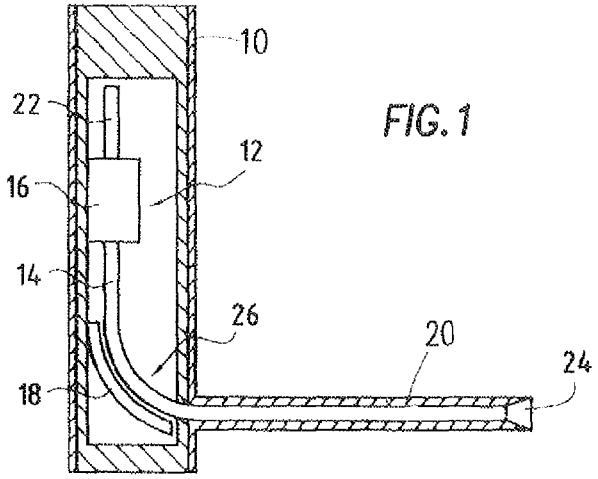

The present invention concerns a drill shaft which can be operated at two different bending stiffnesses. This drill shaft can therefore be used with a drilling machine mounted at some angle from the axis of the hole to be drilled. A typical application is lateral drilling in oil & gas business. In this application, a main well 10 is already drilled and the drilling machine 12 is installed in the main hole 10 (FIG. 1). Rotation is applied to the drill shaft 14 on an axis parallel to that of the main hole 10 by means of a drilling motor 16 having a rotation head that is also parallel to the main hole axis.

The drill shaft 14 passes across a guide device (or section or system) 18 to be bent and aligned with the axis of the lateral hole 20. This change of direction is performed while the shaft 14 is rotated and advanced by a suitable pushing system 22 in the drilling machine 12. Rotation and axial motion are transmitted to the drill bit 24 at the end of the drill shaft 14 to cut more hole. Over the section 26 where direction is being changed, the shaft 14 is in compression, torsion and bending. To permit this combination, low bending inertia is needed to allow short radius turn. However, in the straight section 20 the shaft 14 should be stiff to avoid buckling. This is particularly critical when a long lateral hole 20 is to be drilled.

In the shaft according to the invention, torsion inertia in the shaft is decoupled from bending inertia, such that the bending inertia can be low while passing a curved section and high while drilling a straight section. In most applications, high torque application is required to drive the bit. However if sharp turn is required between the main hole and the laterally-drilled hole, the shaft should be extremely flexible.

Figure 2A:
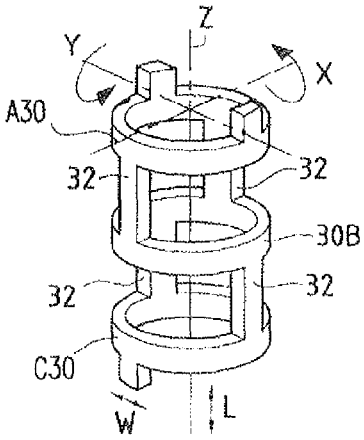

Hollow tube normally couples the tube inertias (bending/torsion). In this invention, a hollow tube is modified by radial grooves to become effectively a stack of rings 30 (FIG. 2*a*). The rings 30 are attached together by straight links 32 which allow high bending flexibility. Due to the use of two links 180° around the shaft 14, the shaft 14 can only bend around the bending axis X, Y perpendicular to the shaft axis Z passing through both links 32 between the adjacent rings A, B or B, C. By placing the links 32 in various azimuthal planes (around the shaft axis Z), it is possible to distribute the shaft bending direction between rings. In the shown example (FIG. 2*a*), the link azimuth is rotated by 90° for each set of rings (the links between rings A and B are at 90° from the links between rings B and C). This combination allows the shaft 14 to bend in all directions.

With this simple design, bending depends on the width W and length L of the link 32. The torque capability of the shaft 14 is determined by the section (thickness T×width W) multiplied by the radius of the shaft 14. Axial load (such as WOB) can also be transmitted by the links 32. With this design, the shaft can be based on a thick-walled tube cut with wide grooves so that the link width is limited for easy bending. The wall thickness will allow the links 32 to transmit high torque. The rings 30 have to be thick enough to support WOB (or axial pull) without deformation as the links of successive rows are rotated by 90°. The properties of the links 32 to allow bending of the shaft 14 must also be balanced against the need to resist collapse under buckling (not too narrow, not too long)

Figure 2B:
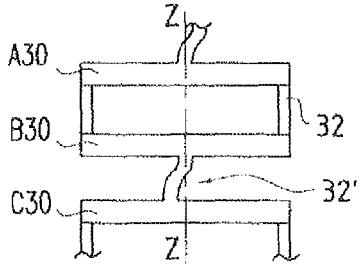

The tendency of the links to form a double bend 32' under torque (FIG. 2*b*) is a torque limitation of the system, to avoid link failure.

Figure 3:
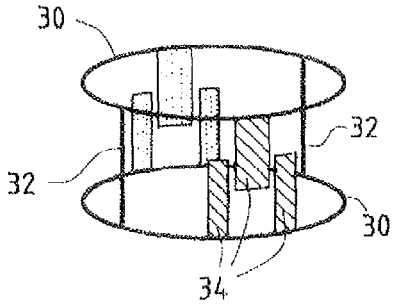

One modification to limit the double bending of the links 32 under torque is to equip the rings 30 with a direct method for torque transmission. One such method is to equip the rings 30 with two sets of teeth 34, 34' as shown in FIG. 3. These act as teeth and spline of collapsible shaft which can take torsional load.

Figure 4B:
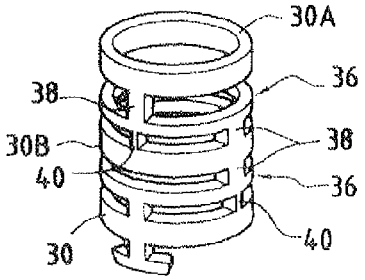

In the next proposed structure (FIGS. 4*a*1 and 4*a*2), the torque capability is improved by the use of a torsion ring 36. This torsion ring 36 is a thin disk attached to the main rings 30 by main links 38 180° apart. There is a 90° angular shift between the main links 38, 38' on both faces of the same torsion ring 36. With this structure, torque can be transmitted from successive shaft rings 30 (for example, from ring A to ring B) while at the same time being inclined thanks to the high flexibility of the torsion ring 36 in its own plane. This structure allows torque transmission under shaft bending.

The proposed structure is not uniform over its length. The torsion ring 36 is attached also by two small links 40 parallel to the shaft on the lower side of the torsion ring 36. These two additional links 40 ensure a pre-defined distance between successive main rings 30. They allow the transmission of axial load (shaft tensile or compressive load) with little or no reduction of distance between the successive rings. These additional axial links 40 are narrow (small angular coverage) so that they can bend in the tangential planes of the shaft 14. Thanks to this low bending resistance, the shaft 14 can easily bend in that direction (as there is NO equivalent additional link at 90° above the torsion ring). The torsion rings 36 flex out of their plane when the axial links 40 bends.

To ensure bending in both directions, the link structure is repeated over the shaft length, but at each repetition, the structure is rotated by 90° (see rings A&B and rings B&C). Other rotation angles could obviously be used, especially to achieve bending in all directions.

With this structure, the shaft can transmit high torque while being flexible and still capable to transmit axial load (tension & compression). High bending flexibility can be achieved by ensuring that the axial links 38 cover most of the shaft length. This can be achieved by providing slots 42 running in the large attachment of the torque ring (see FIG. 4*b*).

Figure 5A:
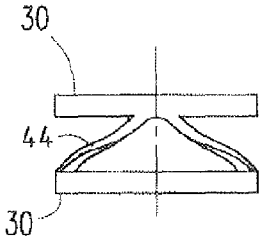
Figure 5B:
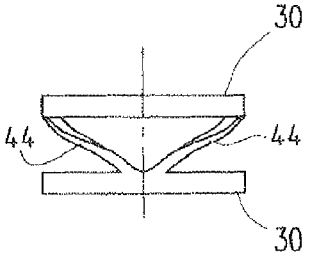

A direct modification of this system is shown in FIGS. 5A-5B. In this structure, the successive rings 30 are held together by four inclined (tilted) links 44, adjacent links having opposite angles of inclination. When the shaft bends, successive rings 30 become non-parallel by flexing the inclined links 44. Axial loads (compression, tension) can be transmitted from ring to ring via the inclined links 44. However, the axial force in the inclined links 44 is increased (compared to the shaft axial load) due to the angle of inclination. Care must therefore be taken to avoid buckling of the links 44 under compression either due to the torque or shaft bending. This structure is flexible in all directions.

Figure 6A:
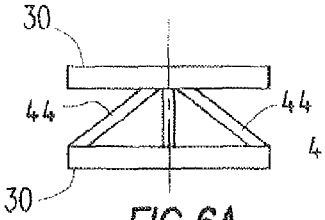
Figure 6B:
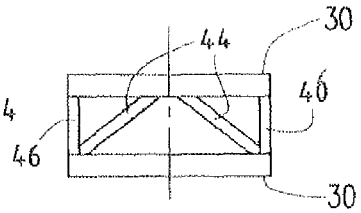

FIGS. 6A and 6B show an improved structure compared to FIGS. 5A and 5B. By virtue of the addition of two axial links 46 (at 180°), the strength of the structure is substantially increased for axial loads. With this embodiment, the axial links 46 bend when the shaft bends. As with the embodiments of FIGS. 2A, 2B, 3, 4A1, 4A2 and 4B, the shaft can only bend by rotating around the axis passing both axial links. The shaft is therefore constructed of successive link cells rotated by 90° (as already explained for the structure of FIGS. 2A, 2B & 4A1, 4A2, 4B above).

Figure 7A:
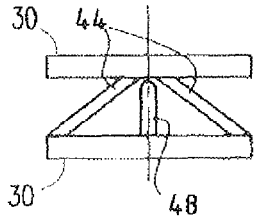
Figure 7B:
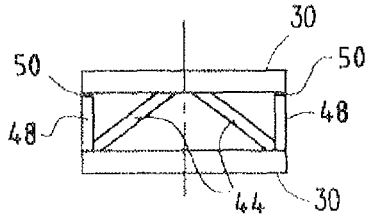

FIGS. 7A and 7B are a modification of the embodiment shown in FIGS. 6A and 6B. The axial link 48 is detached from the ring 30 at one end 50, but is separated therefrom by a very small distance. This small separation allows the link 48 to take axial load only when the system is in compression and deforms enough for the ring 30 to contact the end 50. The axial link 48 does not bend when the shaft bends. With this system, the shaft can only bend by rotating around the axis passing through both axial links 48. In drill-string applications, the compression forces are typically higher than the tension forces on the drill string so the lack of structural reinforcement by the link 48 in tension is not so significant.

In FIGS. 6A, 6B, 7A and 7B, the basic cell structure (two successive rings 30) has different bending stiffness at 90° . There is a rigid direction (due to the axial link 46, 48) and a soft direction at 90° thereto.

Figure 8A:
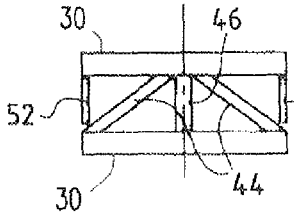
Figure 8B:
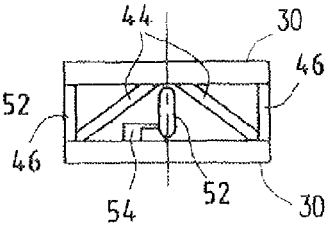

FIGS. 8A and 8B show another modified version of the embodiment shown in FIG. 6. In the soft plane, two removable compression load supports 52 can be positioned between the rings 30. When so positioned, these removable load supports 52 prohibit bending in the soft plane. The supports 52 are held in position by spring mountings 54 allowing the supports to be pushed out of the support position into a neutral position in which they cannot contact the rings 30. In the embodiment shown, the supports 52 can be pushed towards the centre of the shaft, but other movements are possible. With this structure, the basic cell is normally stiff in all directions, but with a minimum local intervention (i.e. by moving the supports 52 against the action of the springs 54), the rigidity in one plane can be suppressed so as to create a temporary soft plane for bending.

Figure 9A:
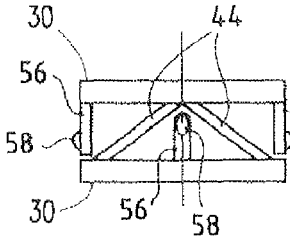
Figure 9B:
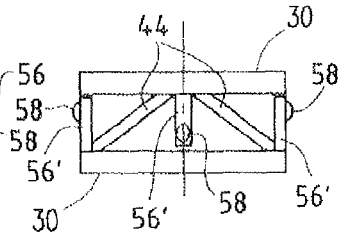

FIGS. 9A and 9B combine the concepts described in FIGS. 7A, 7B & 8A, 8B. In this case, four axial load supports 56, 56' are used. These are attached only at one end (similar to the axial links 48 of FIG. 7A, 7B) alternately to the upper and lower rings. When normally aligned, they prohibit any reduction of spacing between the rings such that the shaft is stiff in all directions. By pushing away one of these supports 56, 56', the shaft can immediately bend in that direction. Pushing of the supports 56, 56' out of their normal positions can be achieved by use of a button 58 on the outer surface of each support. When passing through the bending guide 18 of the drilling machine 12 (see FIG. 1), the guide 18 pushes on these buttons (on the inside of curve 26) allowing the shaft to bend. As soon as the shaft in out of the bending section 18 of the drilling machine 12, the supports 56, 56' remain in their normal positions and the shaft becomes stiff again.

Figure 10A:
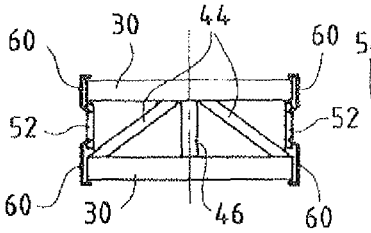
Figure 10B:
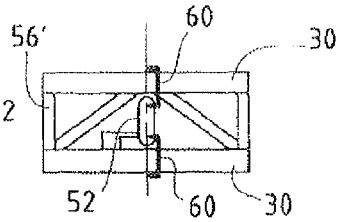

In FIGS. 10A and 10B, the embodiment of FIGS. 8A and 8B is modified by the addition of tension latch 60 on load supports 52. The latches 60 allow the supports 52 to resist both compression and tension loads. When in place, the supports 52 with the latches 60 make the shaft more resistant to bending in the "soft plane". Furthermore, the shaft can resist higher axial pull when the load supports 52 are in their normal position as they can take part of the shaft tension load.

Figure 11:
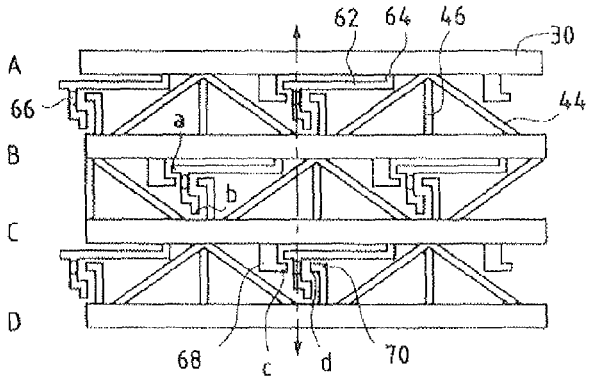
FIG. 11 is a schematic view showing an embodiment of the invention including the features shown in FIGS. 8, 9, 10.

FIG. 11 shows a structure which embodies features of FIGS. 8A, 8B, 9A, 8B and 10A, 10B. For ease of understanding, the shaft is shown unwrapped as it would be if constructed from one sheet of metal which is be rolled and jointed (welded). The basic structure is one of includes links 44 and axial links 46 as before. A latch 62 connected to the ring 30 by a spring mounting 64 is provided with formations which engage lock structures (described in more detail below) fixed to the adjacent rings 30 (e.g. A & B). A push button 66 is provided on the outer surface each latch 62 to operate in the manner as described above in relation to FIGS. 9A,9B, i.e. in the normal position, the shaft is in stiff mode, operation of the button moves the latch 62 out of its normal position into a soft mode. The latch 62 includes upper and lower outer abutment surfaces a, b which are close to, but separated from, the adjacent rings (e.g. B & C). In compression, distortion of the structure causes the formations a, b to contact the rings B, C such that the latch forms an axial load support. Upper and lower tension locks 68, 70 with opposed lock structures extend from each side of a ring 30 (e.g. C & D). Each latch 62 extends between the tension locks 68, 70 and is provided with inner abutment surfaces c, d which are positioned adjacent the lock structures. In tension, adjacent rings 30 (e.g. C & D) move apart slightly due to distortion of the structure such that the inner abutment surfaces c, d engage the lock structures on the tension locks 68, 70 and the latch forms a tension load support. The exact for of structure for compression and tension support can be varied around the principles shown here. As is described above, the latch is moved to an inoperative position when pressure is applied to the button 66 such that it provided no support in either tension or compression and the shaft is placed in a soft mode.

Figure 4B:
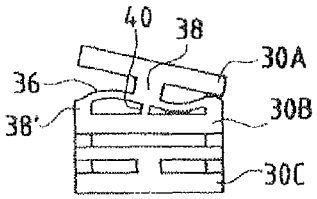
Figure 4B:
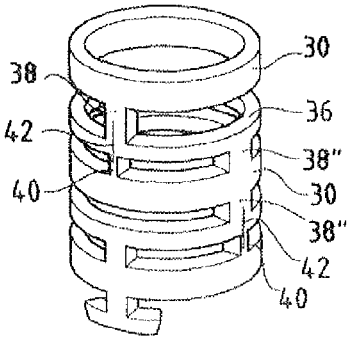
Figure 12:
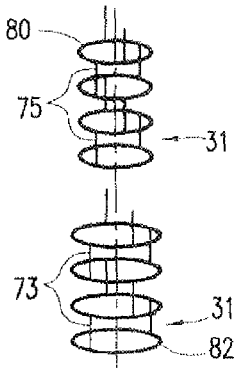
FIG. 12 is a schematic view showing a seventh embodiment of a drill shaft according to the invention, having two shafts with bending cells.

FIG. 12 shows a different embodiment of the invention which uses shafts with successive cells 31 which allow bending in only one direction, but with successive angular de-phasing of the bending direction from cell to cell. In this case, two shafts 72, 74 are used. One shaft 72 has a slightly larger inner diameter than the outer diameter of the other shaft 74 such that the smaller shaft can sit inside the larger one. When so arranged, if the bending cells 31 of both shafts 72, 74 are "in phase" (the axial links 73, 75 of both shafts are aligned for each section), bending is relatively easy as both shafts allow for corresponding bending in each cell. If, on the other hand, the shafts are out of phase by 90° rotation, bending of the drill-string assembly becomes relatively difficult, since for each cell in a shaft allowing bending, the corresponding cell of the other shaft resists bending due to its 90° de-phasing. With this technique, it is obvious that the overall shaft stiffness depends on a 90° rotation between the two shafts 72, 74. Each shaft 72, 74 can be constructed according to the principle shown in FIGS. 2-4 and described above.

Figure 13:
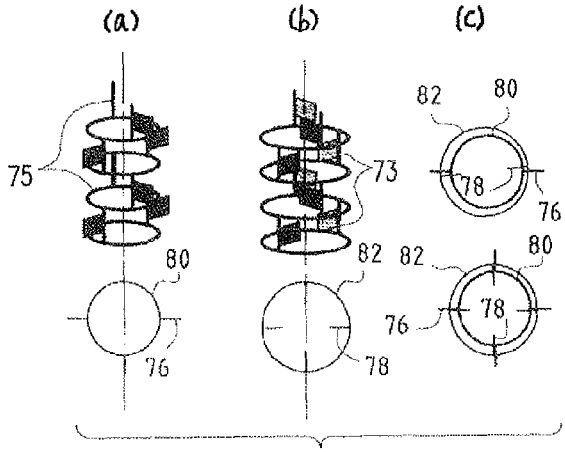
FIGS. 13A, 13B and 13C are schematic views showing further details of one particular implementation of the seventh embodiment, having two shafts with rings with wings.

FIGS. 13A, 13B, 13C show particular implementations of the technique generally described in FIG. 12 above. In this case, the rigidity of drill-string assembly is increased by the presence of wings 76, 78 extending outwardly from the axial links 75 of the inner shaft 74 (shown in perspective and plan view in FIG. 13A), and inwardly from the axial links 73 of the outer shaft 72 respectively (shown in perspective and plan view in FIG. 13B). The wings 76, 78 of one shaft extend between the rings 80, 82 of the other shaft. When the two shafts 72, 74 are out of phase by 90° , the wings 76, 78 of one shaft directly support the middle part of the rings 80, 82 of the other and prohibit any displacement of these rings (which means that the shaft cannot bend). This arrangement is shown as configuration A of FIG. 13. When the shafts are rotated by approximately 90° , the wings 76, 78 do not support the mid points of the rings 80, 82 and bending is allowed. This arrangement is shown as configuration B of FIG. 13.

Figure 14:
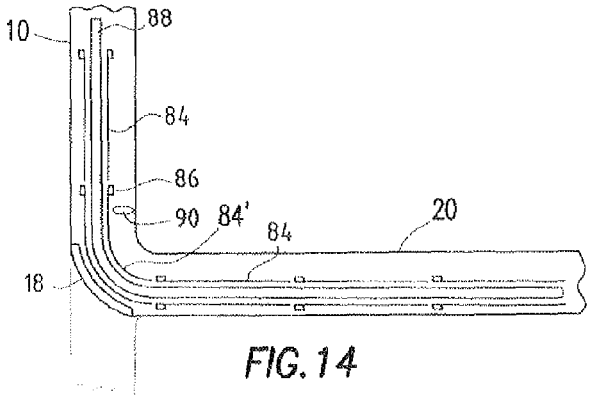
FIG. 14 is a schematic view showing a drilling system incorporating the embodiments of FIGS. 12 and 13.

FIG. 14 shows one implementation of the embodiment of FIGS. 12 and 13 in a drilling system of the general type described in relation to FIG. 1 above. In this case, the external shaft 84 is formed as several separate segments. As shown in FIG. 14, each segment is a few times longer than the bending guide 18. This allows the setting of the drill string assembly into soft mode only when passing over the guide 18 inside the drilling tool. When the drill-string is in straight sections such as in the main bore-hole 10 or in the lateral hole 20, the shaft assembly is set in rigid mode. Normally, only one or two external segments 84' are rotated at a given time to insure the soft mode.

The rotation of the external shaft 84 to insure the desired bending mode setting can be performed by various mechanisms. In the embodiment shown in FIG. 14, the end of each segment 84 of the external shaft is equipped with a small stabilizer 86 which comprises outward protrusions from the segment. The stabilisers 86 cause drag against the borehole wall during drill-string rotation. Under this rotational drag, the external segments 84 have a tendency to lag behind the internal shaft 88 that drives the rotation of the system. A mechanical stop (not shown) ensures that the angular lag can be 90° at most. In this position, the shaft assembly is in rigid mode (as both the inner shaft 88 and the adjacent segment 84 are out of phase by 90°). The external shaft segment 84' engaged in the guide 18 is caused to rotate relative to the inner shaft 88 such that it is positioned to allow bending. This rotation can be achieved using a friction wheel 90 positioned in the upper part of the guide 18 which tends to rotate the external shaft segment 84' in the guide 18 at a higher rotation then the inner shaft 88.

Any of the drill-string structures described above can be lined with a flexible hose to allow fluid to be pumped through the drill-string.

It will be apparent that certain changes can be made to the described systems while remaining within the scope of the invention. For example, where flexibility is achieved by bending of structural members, the same result can be achieved by the use of relatively stiff member with appropriate pivot joints. Also, the embodiments above have bending planes offset by 90°. It is also possible that angles of less than 90° could be used. In such a case, the number of ring cells required to obtain full bending freedom will be greater depending on the actual angle used. Also, the number and position of links and connecting members between each pair of rings may be different to that described above.

The invention claimed is:

1. A drilling tool including a drill shaft for transmitting axial load, said drill shaft comprising a series of coaxial ring members connected together such that adjacent ring members are flexible in an axial plane relative to each other; wherein:

each ring member is connected to an adjacent ring member by a connecting member arranged to transmit torque therebetween;

axial supports extend between the adjacent ring members so as to transmit the axial load therebetween the connecting member and the axial supports allow the adjacent ring members to bend in one axial plane while remaining stiff in another axial plane offset by up to 90°; and the connecting member and the axial supports are constituted by separate physical structures, the axial support comprising at least two axial links extending between circumferentially aligned points on the adjacent ring members, and the connecting member comprising inter-engaging teeth projecting from the adjacent ring members.

2. A drilling tool as claimed in claim 1, wherein a gap exists between the adjacent ring members through which fluid can flow.

3. A drilling tool as claimed in claim 1, wherein the drill shaft comprises at least three adjacent ring members separated by the axial supports.

4. A drilling tool as claimed in claim 1, wherein the axial supports are load bearing axial supports.

5. A drilling tool as claimed in claim 1, wherein the axial supports and the connecting members are configured to enable the drill shaft to comply to a shape of a non-linear guiding mechanism.

6. A drilling tool as claimed in claim 5, wherein the guiding mechanism guides the drilling tool into a hole that is approximately perpendicular to a main hole.

7. A drilling tool as claimed in claim 5, wherein the guiding mechanism is curved in a short radius curve.

8. A drilling tool including a tubular drill shaft structure for transmitting axial load, the tubular structure comprising cutouts defining a series of coaxial ring members, connecting members, and axial supports such that adjacent ring members are flexible in an axial plane relative to each other; wherein the adjacent ring members are flexible in an axial plane relative to each other; wherein:

each ring member is connected to an adjacent ring member by a connecting member arranged to transmit torque therebetween;

the axial supports extend between the adjacent ring members so as to transmit the axial load therebetween the connecting member and axial supports allow the adjacent ring members to bend in one axial plane while remaining stiff in another axial plane offset by up to 90°;

the connecting members and axial supports are constituted by separate physical structures, the axial supports comprising at least two axial links extending between circumferentially aligned points on the adjacent ring members, and the connecting members comprising interengaging teeth projecting from the adjacent ring members.

* * * * *